United States Patent [19]

Bhavsar

[11] 4,000,406

[45] Dec. 28, 1976

[54] LIGHT FIXTURE

[75] Inventor: Jyotindra B. Bhavsar, Houston, Tex.

[73] Assignee: Esquire, Inc., New York, N.Y.

[22] Filed: Nov. 29, 1974

[21] Appl. No.: 528,015

[52] U.S. Cl. ..... 240/11.2 R; 174/DIG. 2; 240/25; 240/51.11 R; 336/68; 336/96; 336/100

[51] Int. Cl.[2] ..... F21S 1/02; H01F 15/02

[58] Field of Search ..... 336/100, 96, 65, 68; 174/DIG. 2, 52 PE, 52 R; 240/73 BC, 73 R, 78 H, 51.11 R, 25, 11.2 R; 248/15, 18, 9, 358 R

[56] References Cited

UNITED STATES PATENTS

| | | | |
|---|---|---|---|
| 2,288,166 | 6/1942 | Kucher | 248/18 X |
| 2,313,131 | 3/1943 | Elias | 240/78 H |
| 2,545,163 | 3/1951 | Naster | 336/96 X |
| 2,852,663 | 9/1958 | Stuffer et al. | 240/78 H X |
| 2,973,895 | 3/1961 | Brown et al. | 248/18 X |
| 3,078,366 | 2/1963 | Winkler | 240/51.11 R |
| 3,154,704 | 10/1964 | Shaffer | 248/18 X |
| 3,299,200 | 1/1967 | Sulzer | 174/DIG. 2 |
| 3,319,203 | 5/1967 | Haughney | 174/DIG. 2 |
| 3,479,081 | 11/1969 | Schaaf | 248/15 X |
| 3,541,478 | 11/1970 | Peterson et al. | 336/96 X |

FOREIGN PATENTS OR APPLICATIONS

| | | | |
|---|---|---|---|
| 588,081 | 11/1933 | Germany | 336/96 |
| 199,769 | 11/1965 | Sweden | 248/18 |

*Primary Examiner*—Thomas J. Kozma
*Attorney, Agent, or Firm*—W. F. Hyer; Marvin B. Eickenroht

[57] ABSTRACT

There is disclosed a light fixture having a ballast therein comprising a substantially enclosed steel case which is mounted on a wall of the steel housing of the fixture and substantially filled with a potting compound in which a magnetic core and coil device is embedded.

8 Claims, 4 Drawing Figures

LIGHT FIXTURE

This invention relates generally to light fixtures, and, more particularly, to improvements in light fixtures of the type in which ballasts are mounted within a steel housing for the light source.

In fixtures of this type, it has been the practice to mount the ballast on a bracket secured to a wall of the housing. Due to the magnetic properties of steel, the walls of the housing absorb vibration due to the magnetic field of the ballast. The housing walls are also subject to mechanical vibrations transmitted to them through the mounting brackets for the ballast. As a result, fixtures of this type may not be usable in certain areas without exceeding permissible noise levels.

An object of this invention is to provide a light fixture of this type in which vibrations due to magnetic field of the ballast are isolated from the housing.

Another object is to provide such a fixture in which mechanical vibrations induced by the ballast are also isolated from the housing.

A further object is to provide a ballast which may be mounted within the housing in such a way as to accomplish one or more of the foregoing objects without substantial modification of the housing.

Still another object is to provide such a ballast which is relatively inexpensive to manufacture.

Yet a further object is to provide such a ballast which is easy to install within the housing.

These and other objects are accomplished, in accordance with the illustrated embodiment of the invention, by a light fixture wherein the potting compound in which the magnetic core and coil device of the ballast is embedded is disposed within and substantially fills a steel case which is mounted on a wall of the housing. The case is substantially enclosed so as to absorb vibrations due to the magnetic field of the device, and thereby isolate the housing therefrom, and since it is relatively small as compared to the housing, noise due to these vibrations is considerably smaller than it would be if the fixture had a conventional ballast.

More particularly, the walls of the case are spaced from the housing walls, and the means by which the case is mounted on a wall of the housing includes cushioning means disposed between the case and the housing. Thus, the housing is also isolated from mechanical vibrations, which instead are confined to the relatively small case, thereby further reducing the noise level which would otherwise occur in a conventional fixture.

Although the mass of the device and potting compound in which it's embedded will tend to dampen vibrations of the case, it is also preferred to pour the compound in place within the case, and to anchor the sides of the compound of the case by means of clips which prevent movement of the compound within the case even though it should shrink upon hardening. One side of the case is preferably open to facilitate pouring of the compound and to accommodate wiring from the side of the compound.

In the illustrated embodiment of the invention, the case is supported from the top wall of the housing by means of a pair of brackets each having a flange extending generally parallel to the top wall, a pair of flanges on opposite sides of the case, each case flange being disposed above a bracket flange, a cushion between each pair of bracket and case flanges, and a fastener extending through each pair of flanges and having surfaces bearing on adjacent sides thereof so as to support the weight of the ballast on the cushions. More particularly, the ballast is mounted intermediate a wall of the housing and a reflector across a window in the housing, and the open side of the case faces the reflector, which is made of aluminum and thus will not absorb vibrations due to the magnetic field.

In the drawings, wherein like reference characters are used throughout to designate like parts:

Figure 1:
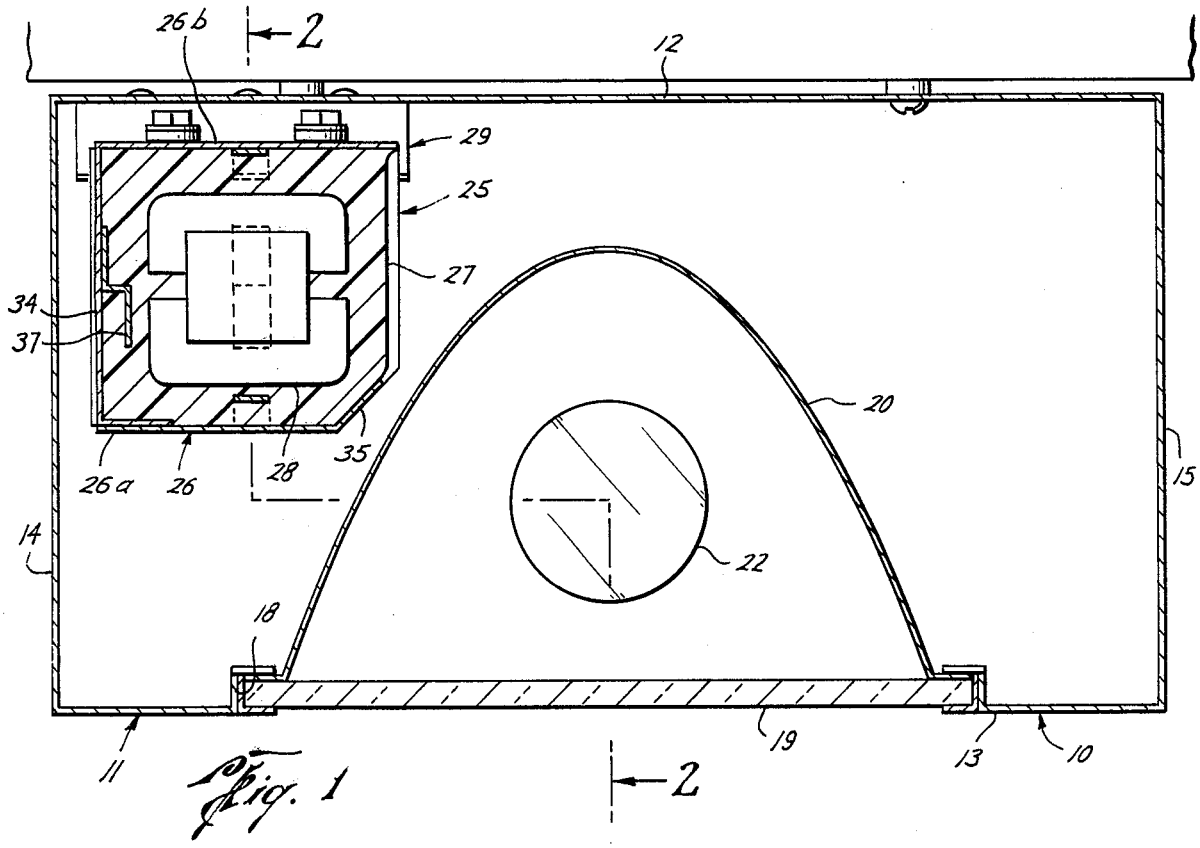
FIG. 1 is a cross-sectional view of a light fixture constructed in accordance with the present invention.
Figure 2:
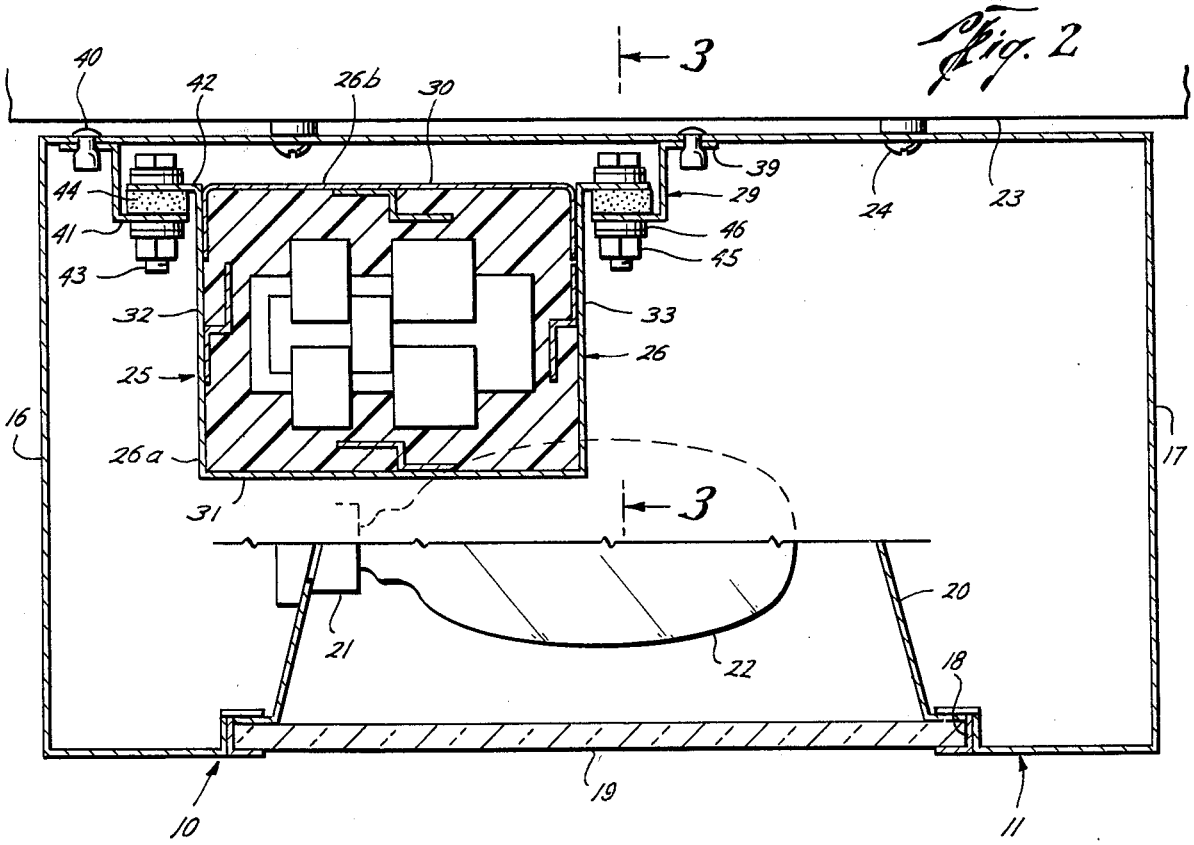
FIG. 2 is a longitudinal sectional view of the light fixture of FIG. 1 as seen along broken lines 2—2 of FIG. 1.

With reference now to the details of the above-described drawings, the overall light fixture which is indicated in its entirety by reference character 10, is shown in FIGS. 1 and 2 to comprise a housing 11 of box-like construction having top and bottom walls 12 and 13, respectively, and side walls 14, 15, 16 and 17 made of steel. A window 18 is formed in the bottom wall 13 of the housing, and is closed by a pane 19 of transparent or translucent material which is held within a recess about the window by suitable means (not shown). An aluminum reflector 20 is mounted in the housing opposite the window 18, and a socket 21 is mounted by the reflector in position to receive a lamp 22 between the inner reflector surface and the window in order that light therefrom will be reflected out of the window.

As shown, the housing is mounted from a horizontal surface 23, which may be a ceiling, although it will be understood that the fixture housing may instead be disposed within a recess in a ceiling. In any event, the housing is mounted from the surface 23 by means of screws 24 extending through its top wall 12. When so mounted, the fixture causes light from the lamp 22 to be reflected downwardly through the window 18.

As shown in FIG. 1, the reflector 20 is substantially dome-shaped in cross section, with its upper end extending close to the top wall 12 of the fixture housing. As shown in FIGS. 1 and 2, the reflector is arranged generally symmetrically of the opposite pairs of side walls of the housing. The ballast, which is indicated in its entirety by reference character 25, is mounted on the housing intermediate the side wall 14 and the adjacent side of the reflector, as viewed in FIG. 1, and generally on the left side of the housing, as viewed in FIG. 2. As will be appreciated, the ballast may be moved through an access opening in the housing, such as window 18, for purposes of assembly and repair. As shown, the ballast is only a fraction of the size of the housing.

The ballast includes a steel case 26 which is substantially filled by a potting compound 27 in which a magnetic core and coil device 28 is embedded. The case, which is supported from the top wall 12 of the housing by means including brackets 29, is also of box-like construction having top and bottom walls 30 and 31, respectively, and side walls 32, 33 and 34, the wall 34 being opposite an opening in the side of the case facing the reflector.

As previously mentioned, the open side of case 26 permits potting compound 27 to be poured in place. Thus, the case may be turned on end to dispose its open side on top, and the core and coil device 28 may be supported in a generally central position therein, as shown in FIGS. 1 and 2. The potting compound may then be poured into the case and permitted to harden therein prior to assembly in the housing. A flange 35 extending upwardly from bottom wall 31 of the case assists in retaining the hardened potting compound in the case, and also avoids interference between the lower righthand corner of the case, as seen in FIG. 1, and the reflector 20.

Figure 4:
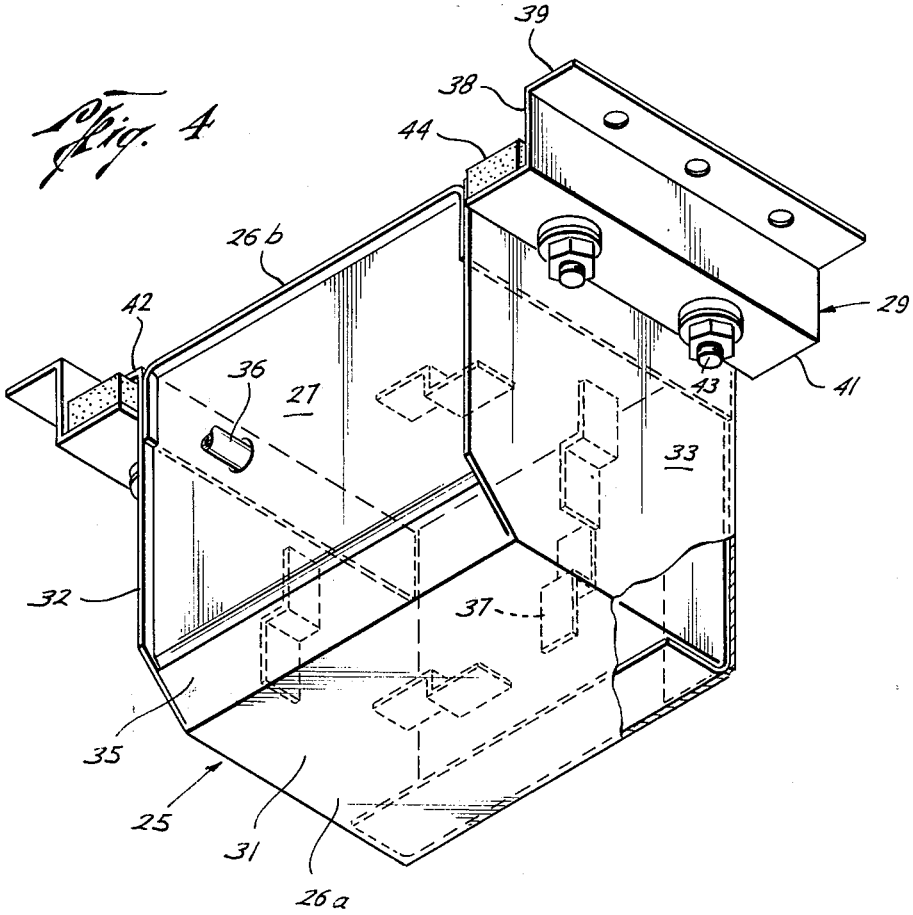
FIG. 4 is a perspective view of the ballast of the light fixture together with the means for mounting it on the fixture housing.

The open side of the case also facilitates the extension of wiring 36 therethrough, as shown in FIG. 4, especially since the wiring may emerge from the magnetic core and coil device at one of many different locations along the side thereof, which would make it difficult to predetermine the location of an opening through a wall over the open side to receive the wiring 36. As will be understood, the wiring is adapted to connect the device 28 with the socket 21 and a power source externally of the fixture, in a manner well known in the art.

Clips 37 are secured to the walls of the case so as to anchor the hardened potting compound thereto, and thereby prevent the compound from pulling away from the walls should it shrink during hardening. As shown, these clips are preferably Z-shaped, with one leg being secured as by spot welding to the adjacent wall of the case, and another leg thereof being spaced from the wall and extending generally parallel thereto.

Even though the side of the ballast case opposite the reflector is open, the reflector, being of a non-magnetic material, will not absorb vibrations due to the magnetic field of the device 28. Also, as will be understood from FIGS. 1 and 2, each of the walls of the ballast case 26 is spaced from a correspondng wall of the housing, so that with the case also being spaced from the reflector 20, there is no direct contact or engagement of the case with the housing other than through the mounting including bracket means 29 which, as will be described, include a cushion between the mounting parts of the case and the brackets to prevent any metal-to-metal contact between the case and housing.

The mounting means 29 includes a pair of substantially Z-shaped brackets 38 having their upper flanges 39 secured by rivets 40 to the top wall 12 of the housing to dispose their lower flanges 41 generally horizontally to the top wall of the housing. Outwardly extending flanges 42 on opposite sides of the case of the ballast are disposed over bracket flanges 41 and secured thereto by fasteners 43 so as to support the ballast case with its top wall 30 thereof generally horizontal and parallel to the top wall 12 of the housing. More particularly, a cushion 44 in the form of an elongate silicone pad extends between the flanges for substantially their entire lengths, and fasteners 43 extend through aligned holes in the flanges and the pads to hold the pads in place.

Figure 3:
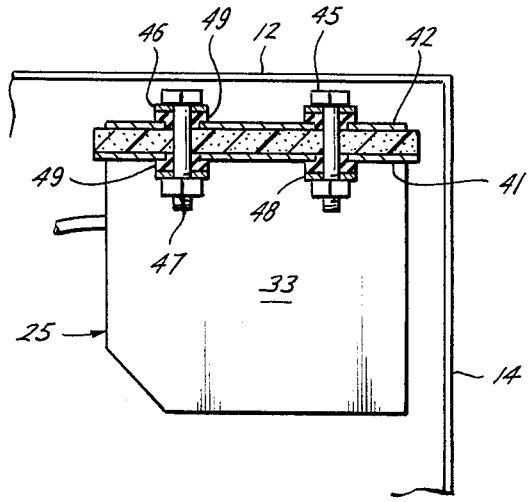
FIG. 3 is a cross-sectional view of a portion of the light fixture, as seen along broken lines 3—3 of FIG. 2.

As best shown in FIG. 3, each fastener 43 comprises a bolt having a head 45 on its upper end above a washer 46, and a nut 47 over the lower end of the bolt beneath a washer 48. Each washer bears upon an elastomer grommet 49 having a reduced diameter end which fits closely within holes in the flanges so as to prevent metal-to-metal contact in the event of sidewise vibrations. As will be understood, the nuts may be made up on the bolts with sufficient tightness to precompress the pads 44 to a desired extent, although in any event, the pads are in compression due to the weight of the ballast being supported therefrom.

The ballast case is made in two parts **26*a* and 26*b* each comprising a metal sheet cut to shape and bent upon itself to form sides of the case. Thus, sheet 26*a* is bent to form side walls 32 and 33 on opposite sides of bottom wall 31, mounting flanges 42 at the upper end of each of said side walls, and flanges along the rear edge of each said side wall adapted to be welded to the back of side wall 34, and the flange 35 on the end of bottom wall 31. Sheet 26*b*, on the other hand, is bent to form top wall 30 and side wall 34, a flange on the lower end of said side wall 34 adapted to be welded to the inside of bottom wall 31, and flanges along the side of the top wall 30 adapted to be welded to side walls 32 and 33**.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A light fixture, comprising an enclosed housing having steel walls and a window therein, means for mounting a lamp opposite the window, a reflector in the housing for reflecting light from the lamp through the window, a ballast, including a steel case which is enclosed except for one side, and a magnetic core and coil device embedded within a potting compound which substantially fills the case, and means mounting the ballast in the housing with the case spaced from the housing walls, said mounting means including parts connecting the case to a wall of the housing and cushioning means between said parts and each of the case and housing.

2. A light fixture of the character defined in claim 1, wherein the open side of the ballast case faces toward another wall of the housing.

3. A light fixture of the character defined in claim 2, wherein a portion of the reflector is disposed between said open side and other housing wall.

4. A light fixture of the character defined in claim 1, wherein said housing has top, bottom and side walls, and the ballast is mounted near the intersection of two of said walls.

5. A light fixture of the character defined in claim 4, wherein the ballast is mounted near a corner of the housing at the intersection of three of its walls.

6. A light fixture of the character defined in claim 1, wherein the wiring from the core and coil device extends through the potting compound and out the open side of the case.

7. A light fixture of the character defined in claim 1, wherein at least one clip is secured to the inner side of each wall of the case and anchored to adjacent portions of the potting compound.

8. A light fixture of the character defined in claim 1, wherein said mounting means includes a first pair of brackets on the housing wall having parallel flanges, a second pair of brackets on the case having parallel flanges facing oppòsitely to and extending coextensively of the flanges of the first pair, and a cushion between the oppositely facing flanges of said pairs, and said connecting parts comprising fasteners which extend through said oppositely facing flanges and compress the cushion therebetween, and elastomeric grommets surrounding the fasteners to isolate them from the flanges.

* * * * *